US007377127B2

(12) United States Patent
Mak

(10) Patent No.: US 7,377,127 B2
(45) Date of Patent: May 27, 2008

(54) CONFIGURATION AND PROCESS FOR NGL RECOVERY USING A SUBCOOLED ABSORPTION REFLUX PROCESS

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 680 days.

(21) Appl. No.: 10/478,705

(22) PCT Filed: May 8, 2002

(86) PCT No.: PCT/US02/14860

§ 371 (c)(1),
(2), (4) Date: Jun. 14, 2004

(87) PCT Pub. No.: WO03/095913

PCT Pub. Date: Nov. 20, 2003

(65) Prior Publication Data

US 2004/0206112 A1 Oct. 21, 2004

(51) Int. Cl.
*F25J 3/00* (2006.01)

(52) U.S. Cl. ..... 62/630; 62/635; 62/621

(58) Field of Classification Search ..... 62/620, 62/632, 928, 929, 630, 635, 621
See application file for complete search history.

(56) References Cited

U.S. PATENT DOCUMENTS 4,061,481 A * 12/1977 Campbell et al. ..... 62/621
6,182,469 B1 * 2/2001 Campbell et al. ..... 62/621
6,915,662 B2 * 7/2005 Wilkinson et al. ..... 62/621

* cited by examiner

*Primary Examiner*—Cheryl Tyler
*Assistant Examiner*—John Pettitt
(74) *Attorney, Agent, or Firm*—Fish & associates, PC

(57) ABSTRACT

An NGL recovery plant includes a demethanizer (7) in which internally generated and subcooled lean oil absorbs $CO_2$ and $C_2$ from a gas stream (11), thereby preventing build-up and freezing problems associated with $CO_2$, especially where the feed gas has a $CO_2$ treatment at ethane recoveries above 90% and propane recoveries of at least 99%.

18 Claims, 4 Drawing Sheets

CONFIGURATION AND PROCESS FOR NGL RECOVERY USING A SUBCOOLED ABSORPTION REFLUX PROCESS

FIELD OF THE INVENTION

The field of the invention is natural gas liquids (NGL) recovery, and especially NGL recovery from gas streams with high $CO_2$ content.

BACKGROUND OF THE INVENTION

As the price of natural gas for use as fuel and chemical feedstock increases, new reserves of natural gas have regained considerable attention. However, many of the new reserves have relatively high percentages of acid gases, and especially carbon dioxide, while having relatively low percentage of desired hydrocarbons. Therefore, separation of carbon dioxide from natural gas has become critical to an economically attractive use of new natural gas reserves, and various methods and configurations have been developed.

In one method of separating carbon dioxide from a natural gas feed, at least a portion of the gas feed is subjected to cryogenic expansion. A typical cryogenic expansion process includes dehydration, cooling and partially condensation of the feed gas, wherein a first portion of the vapor fraction of the feed gas is turbo-expanded to the mid section of a column, and wherein a second portion is subcooled in an overhead subcooled exchanger and fed to the top of the demethanizer or deethanizer. Cryogenic processes are generally preferred due to their relatively simple configuration and relatively high efficiency. An example of a typical cryogenic process is shown in Prior Art FIG. 1, and particular configurations are described, for example, in U.S. Pat. No. 4,157,904 to Campbell et al., U.S. Pat. No. 4,690,702 to Paradowski et al., and U.S. Pat. No. 6,182,46 to Campbell et al.

However, the use of a turbo-expander in such configurations is generally limited to use of a feed gas with a relatively low $CO_2$ content, most typically 2 mol % and less. Where the feed gas has a higher $CO_2$ content, problems associated with $CO_2$ freezing in the top of the demethanizer are frequently encountered. This is especially critical where relatively high ethane recovery is desired due to the low operating temperature requirements by the column overhead, which typically causes an increase in internal reflux and buildup of $CO_2$.

To circumvent at least some of the problems with $CO_2$ freezing, $CO_2$ may be removed in an upstream $CO_2$ removal unit to reduce the feed gas $CO_2$ content before feeding to a NGL recovery plant. While $CO_2$ removal units generally reduce difficulties associated with freezing, addition of such units requires substantial capital investment and operating costs.

In another method of separating carbon dioxide from a natural gas feed, $CO_2$ removal from a feed gas for NGL recovery may be performed using a solvent (here: lean oil) absorption process. Lean oil absorption processes generally include a lean oil, typically a butane (or higher hydrocarbon) stream, to absorb the $C_2$ plus hydrocarbons from the feed gas. An example of a typical lean oil absorption process is shown in Prior Art FIG. 2 and particular configurations are described, for example, in U.S. Pat. No. 6,340,429 to Minnkkinen, et al., and U.S. Pat. No. 5,687,584 to Mehra et al. Among other advantages, such processes may operate at a higher temperature, thus often avoiding $CO_2$ freezing in the columns. However, most conventional lean oil absorption processes require substantial quantities of energy for lean oil regeneration and lean oil cooling. Furthermore, and especially where the $CO_2$ concentration in the feed gas is relatively high, a high lean oil circulation is required to achieve a satisfactory NGL recovery. Therefore, and at least from an energy efficiency and process simplicity perspective, cryogenic turbo-expander processes are generally preferred over the lean oil absorption process.

Consequently, although various configurations and methods for NGL recovery are known, all or almost all of them suffer from one or more disadvantages. Thus, there is still a need to provide methods and configurations for improved NGL recovery.

SUMMARY OF THE INVENTION

The present invention is directed towards NGL plants that include a cryogenic expansion process in which build-up and/or freezing problems of carbon dioxide are significantly reduced, if not even completely avoided, even at carbon dioxide contents of a natural gas feed of at least 2 mol %, and more typically at least 10 mol %.

In one aspect of the inventive subject matter, contemplated plant will include a distillation column with a rectification section and an absorption section, wherein the column is fluidly coupled to a first separator that separates a feed into a lean oil liquid and a vapor, wherein a first portion of the vapor is expanded in a turbo-expander and introduced into the absorption section, while a second portion of the vapor is cooled and introduced into the rectification section. In further contemplated plants, the lean oil liquid is cooled and introduced into the absorption section thereby reducing the carbon dioxide concentration in the rectification section of the distillation column.

Contemplated plants may further comprise a second separator located at plant inlet that receives a cooled natural gas feed and separates the cooled natural gas feed into a vapor portion of the natural gas, a liquid portion of the natural gas, and water, and wherein the feed of the first separator comprises at least some of the vapor portion of the natural gas. In preferred aspects, the vapor portion of the natural gas may be dried using molecular sieves, and cooled using an overhead product of the rectification section of the distillation column and an optional external refrigerant.

In another aspect of the inventive subject matter, a portion of the lean oil liquid is let down in pressure and used as a refrigerant to cool the feed of the first separator, and it is further preferred that the second portion of the vapor and the lean oil liquid are cooled using an overhead product of the rectification section of the column.

In a further aspect of the inventive subject matter, the distillation column may further comprise a stripping section that removes at least a portion of methane that is absorbed in the lean oil liquid and produces a bottom product comprising natural gas liquids, wherein the stripping section may further receive the portion of the lean oil liquid that is let down in pressure. An additional feed stripper located at plant inlet may be provided that (a) receives the liquid portion of the natural gas, (b) forms a bottom product comprising natural gas liquids, and (c) that produces a stripper column overhead product that is dried, and introduced into the distillation column. Alternatively, the stripping section of the distillation column may be replaced with a separate and additional stripping column, which allows the process to operate for a full range of NGL recovery, from ethane recovery to propane recovery Consequently, a method of operating a plant may include one step in which a distillation column comprising a rectification section and an absorption section is provided. In another step, a feed is separated in a first separator into a lean oil liquid and a vapor, and in yet another step, the vapor is divided in a first portion and a second portion, wherein the first vapor portion is expanded in a turbo-expander and introduced into the absorption section, and wherein the second vapor portion is cooled and introduced into the rectification section. In a still further step, the lean oil liquid is divided in a first portion and a second portion, wherein the first liquid portion is cooled and introduced into the absorption section, thereby reducing the carbon dioxide concentration in the rectification section of the column; and wherein the second lean oil portion is reduced in pressure that is utilized for feed gas cooling before entering the stripping section

BRIEF DESCRIPTION OF THE DRAWING

Prior Art

Prior Art

DETAILED DESCRIPTION

The inventor has discovered that various gas feeds, and especially natural gas feeds with high $CO_2$ content, may be processed in a plant including a cryogenic expansion process for $C_2$ recovery without (or at least with substantially reduced) $CO_2$ freezing problems, when a lean oil is produced in a separator, subcooled and introduced to the mid section of a demethanizer. Such configurations are particularly advantageous when the gas feed comprises at least 2 mol %, more typically at least 4 mol %, and most typically at least 10 mol % $CO_2$.

Figure 1:
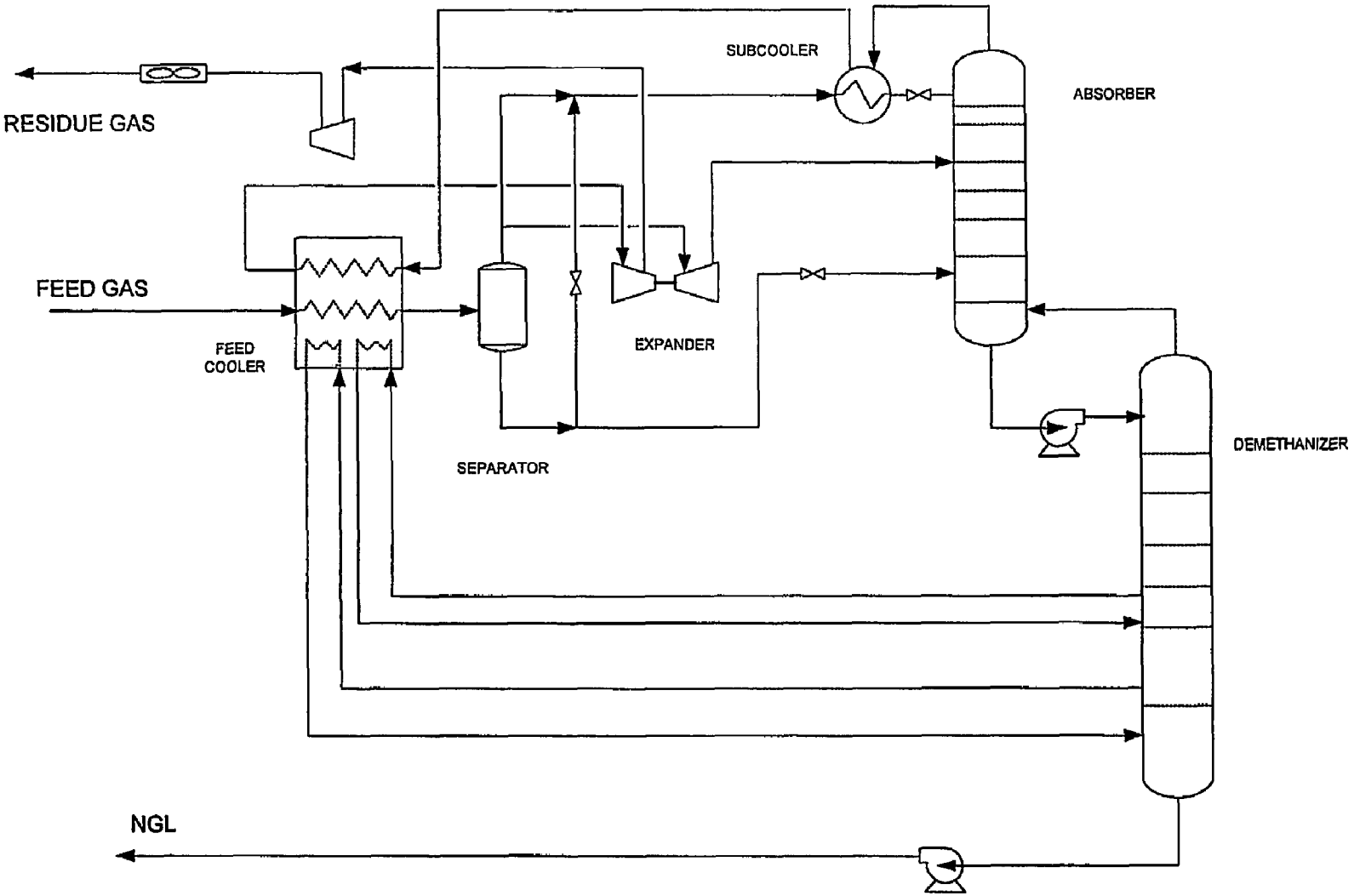
FIGURE 1 (PRIOR ART)
FIG. 1 is a schematic diagram of an exemplary NGL plant configuration that includes a cryogenic expander process.
Figure 2:
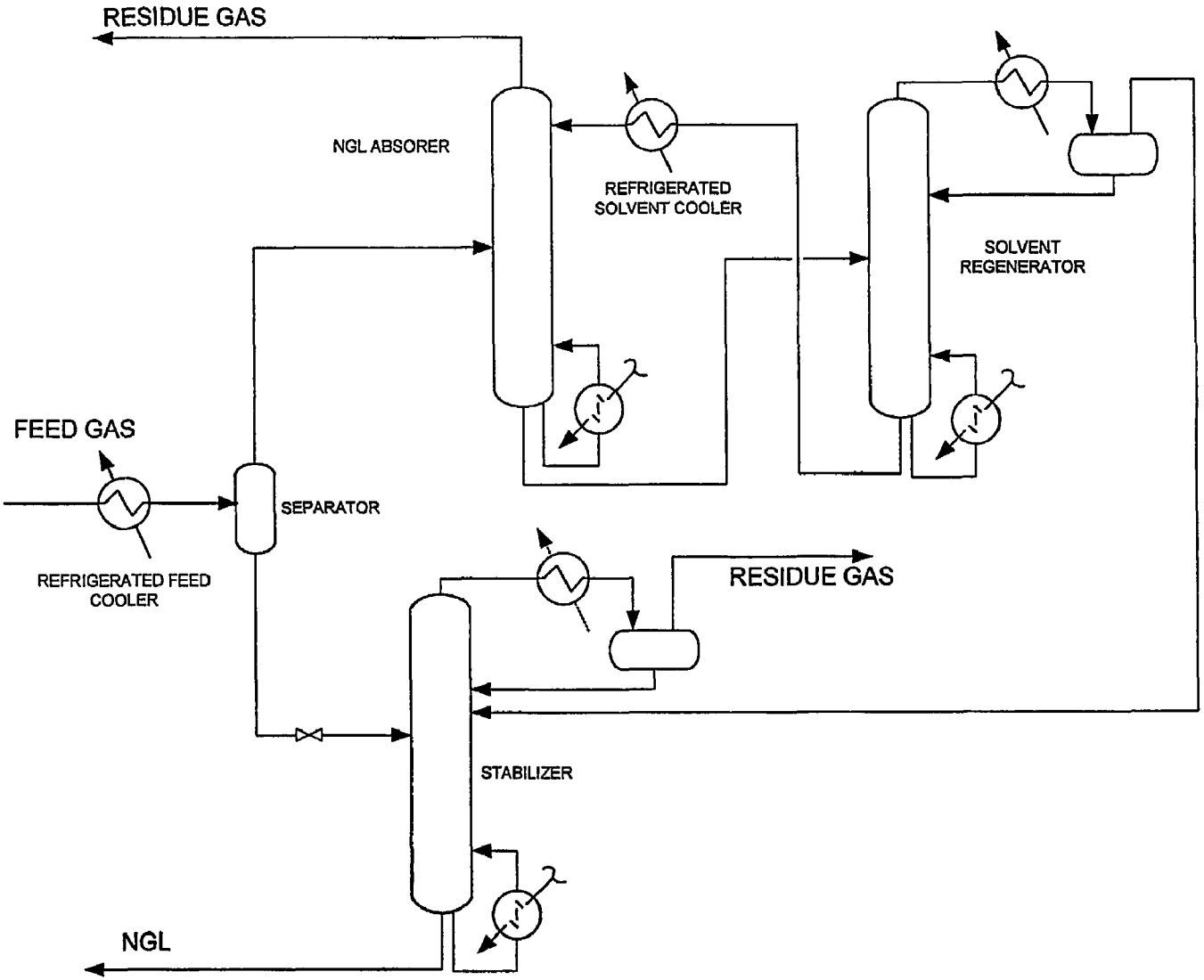
FIGURE 2 (PRIOR ART)
FIG. 2 is a schematic diagram of an exemplary NGL plant configuration that includes a refrigeration lean oil absorption process.
Figure 3:
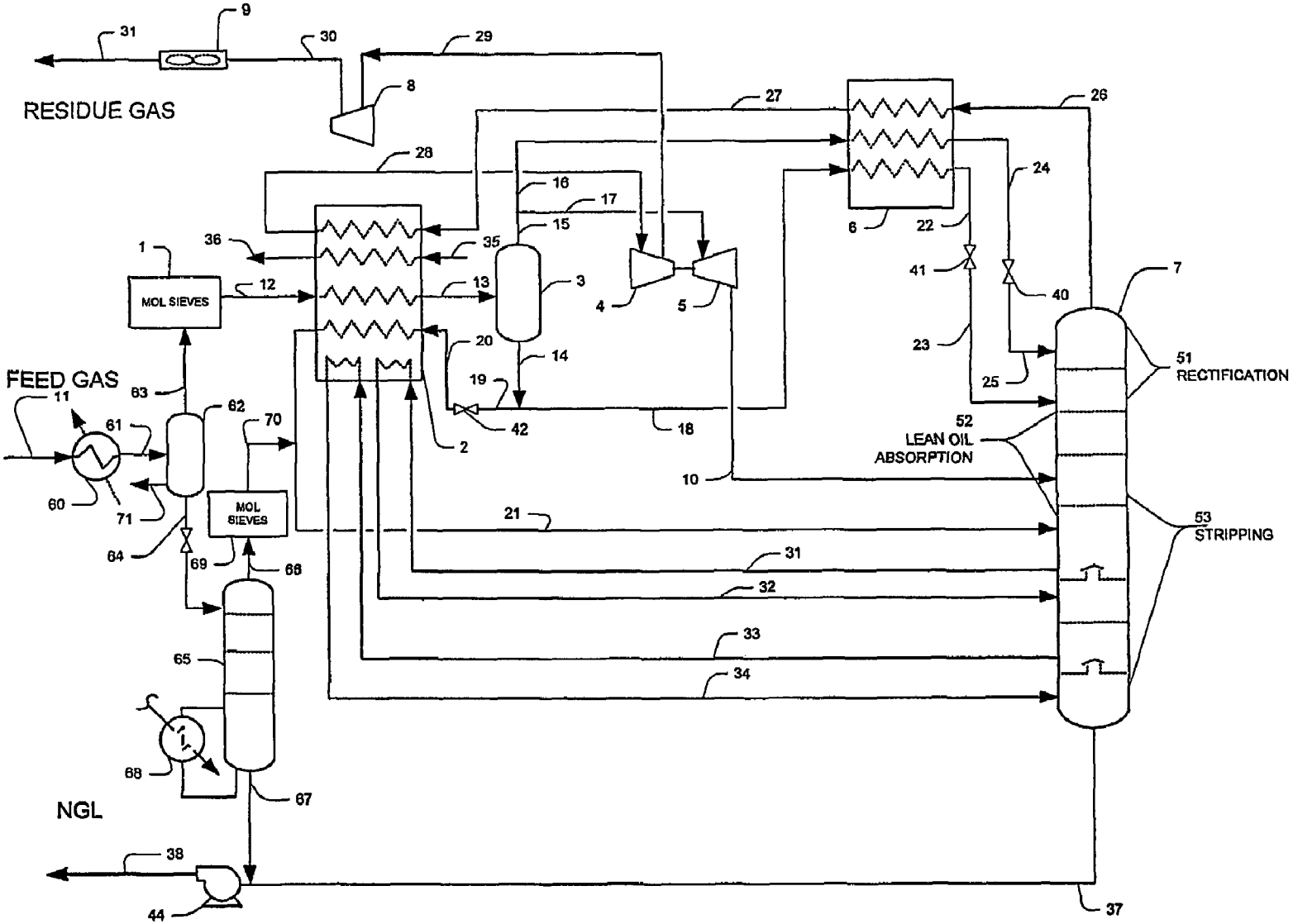
FIG. 3 is a schematic diagram of one exemplary NGL plant configuration that includes a subcooled absorption reflux process.

In an exemplary preferred aspect of the inventive subject matter as depicted in FIG. 3. A natural gas feed 11, with a typical composition by mole percent of 80% C1, 8% C2, 4% C3, 2% C4, 3% C5+ and 3% CO2 at 120° F. and 1100 psig, is cooled in the feed gas cooler 60 to typically 60° F. to 70° F., thereby forming cooled feed gas 61 typically having a temperature just above the feed gas hydrate point. The cooled feed gas 61 is separated in an inlet three-phase separator 62, from which water 71 is removed, thereby greatly reducing size and energy requirement of the downstream gas drier 1 (e.g., molecular sieve unit). The liquid portion 64 of the cooled feed gas (hydrocarbon liquid) is letdown in pressure and fed to a stripper 65, typically operating at 450 psig, which is reboiled with a bottom reboiler 68, typically operating at 330° F., and produces a stripper overhead vapor 66 containing $C_2$ and lighter components, and a stabilized NGL bottom product 67. The overhead vapor 66, typically at 80° F. to 110° F., is dried in a gas drier 69 (e.g., molecular sieve unit) to produce a dried vapor stream 70. (The regeneration gas for drier 69 may be provided by the regeneration system for drier 1). The dried vapor stream 70 is then sent to the lower section of the demethanizer 7 by either blending stream 70 with the heated liquid 21 from the feed exchanger 2 or directly to the demethanizer 7, the choice of which predominantly will depend on the composition of the feed gas.

The vapor portion 63 (hydrocarbon vapor) of the cooled feed gas from the inlet separator 62, typically at 60° F. to 70° F., is fed to gas drier 1 prior to entering the feed cooler 2 as cooled and dried vapor portion stream 12, wherein stream 12 is cooled by the demethanizer overhead product 27, side reboiler streams 31 and 33 (which are recirculated via streams 32 and 34, respectively), letdown of high-pressure lean oil liquid 20, and an optional external refrigerant 35. The so cooled stream 13, typically at −25° F. to 10° F., is then separated in a high-pressure separator 3 where it is separated into a vapor portion 15 and a liquid portion 14. Liquid portion 14 is generally of a raw cut condensate quality containing the $C_4^+$ components and is well suited to be used as lean oil. The composition of this stream can be adjusted by varying the gas cooling temperature of stream 13. At least a portion of stream 14, typically 15% to 35%, is used as lean oil via stream 18, which is subcooled by column overhead vapor in the subcooler 6 to stream 22 to typically −90 to −110° F., prior to being letdown in pressure via JT valve 41 to stream 23, typically at −95° F. to −115° F., and fed to the absorption section 52 of the distillation column. The subcooled liquid condenses and absorbs the $C_2$ and $CO_2$ components in the demethanizer and prevents them to a significant degree (i.e., at least 90%) from reaching the upper rectification section 51. As a result, the $CO_2$ content in the overhead vapor is reduced, thereby avoiding $CO_2$ freezing problems. The other portion of the high-pressure separator liquid stream 19 is letdown in pressure via JT valve 42, and is chilled by Joule-Thomson effect to stream 20 to typically at −50° F. to −70° F. The refrigerant content of stream 20 is used to cool the feed gas in the feed cooler 2. Outlet stream 21 from feed cooler 2, typically at 10° F. to 40° F., enters the lower stripping section 53 of the demethanizer.

The vapor portion 15 from the high-pressure separator 3 is split into two streams, 16 and 17. First portion 16, typically 30% to 40% of the total flow, is subcooled in the overhead subcooler 6 to stream 24, typically at −115° F. to −135° F., which is letdown in pressure via JT valve 40 to stream 25, typically at −135° F. to −155°. The subcooled stream 25 enters the top of the demethanizer column as a cold reflux to the rectification section 51. The second portion 17, typically 60% to 70% of the total flow, is expanded across the expander 5 to the demethanizer pressure, typically at 350 psig to 450 psig, thereby cooling the expanded vapor stream 10 to typically −80° F. to −100° F., which is fed to the mid section of the absorption section 52. Demethanizer overhead product 26, typically at −125° F. to −145° F., provides cooling in the column overhead subcooler 6 and further cooling in the feed cooler 2 via streams 27 and 28 before recompression in compressor 4 (driven by expander 5) and recompressor 8 (as indicated by streams 29 and 30). Recompressed gas is then cooled by aircooler 9 before leaving the plant as sales gas stream 31.

The demethanizer column 7 further comprises a stripping section 53 in which methane is stripped from the liquid from the absorption section 52 with side reboilers via streams 31-34, with heat supplied from feed cooling in exchanger 2. The column bottom product, typically at 50° F. to 80° F., leaves the column as stream 37, which is then combined with the NGL stream 67 from stripper 65, and pumped by pump 44 to NGL product stream 38

Figure 4:
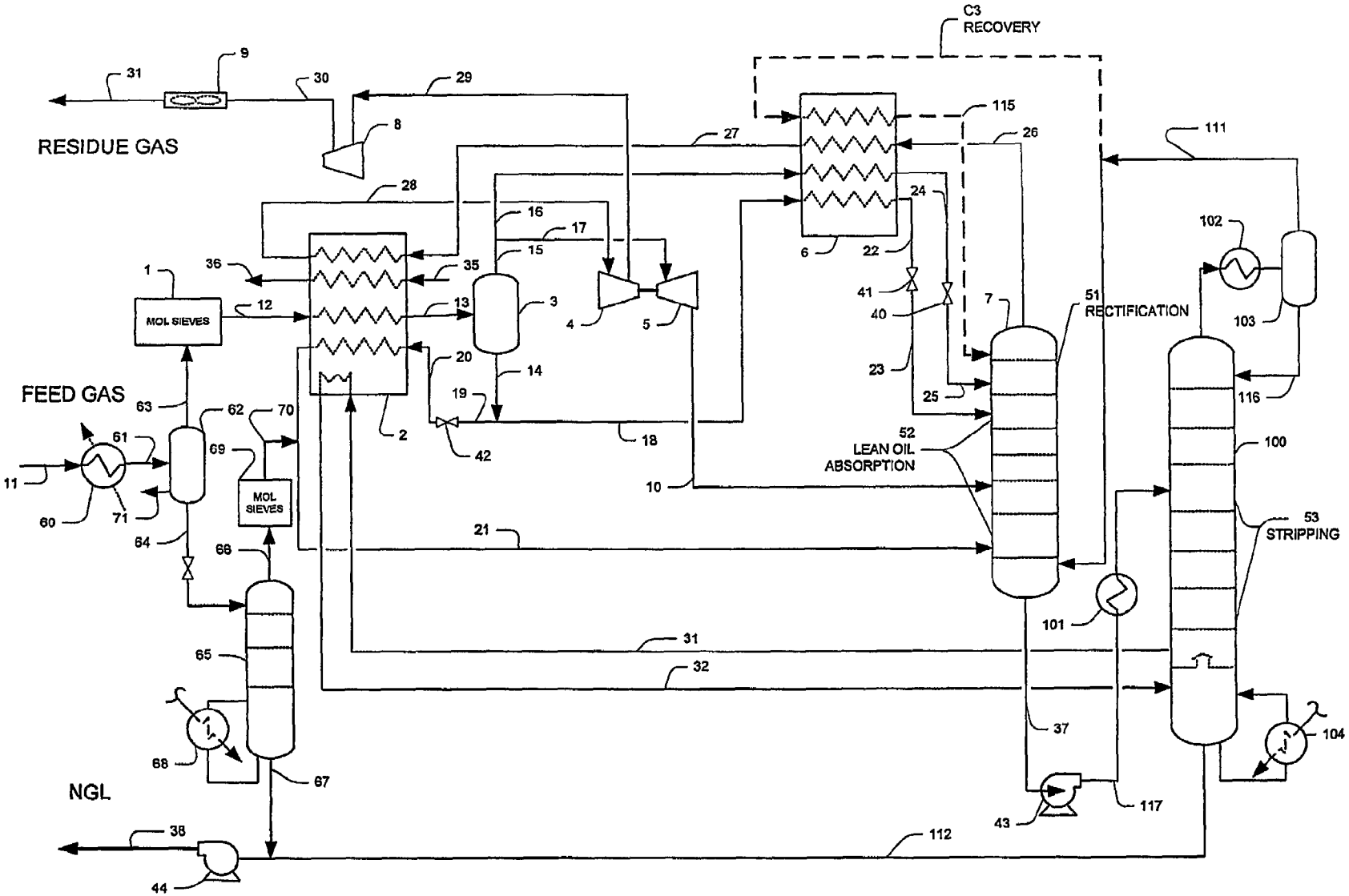
FIG. 4 is a schematic diagram of another exemplary NGL plant two column configuration that includes a subcooled absorption reflux process.

Alternatively, as depicted in FIG. 4, the plant may also be configured in a two-column configuration, wherein the first column 7 (e.g., demethanizer) has a rectification section 51 and an absorption section 52, and wherein the second column 100 has a stripping section 53. This two-column configuration can be used for either ethane or propane recovery, which provides additional benefit for ethane rejection during seasons of low ethane demand or high natural gas price. Here, liquid bottom product 37 is pumped via pump 43, line 117, and interchanger 101 to the upper section of the second column 100, which acts as a stripping column. (A side reboiler can be employed in the second column to recover the refrigerant content by chilling the feed gas). The stripper column overhead, typically at −20 to −60° F. (the value depends on the levels of $C_2$ recovery) is partially condensed in exchanger 102 and separated in separator 103 into the liquid reflux stream 116 and a vapor portion 111, which is for ethane recovery routed to the bottom of the first column 7 or for propane recovery subcooled in subcooler 6 to form stream 115 before entering the first column as reflux (see dashed lines in FIG. 4). Reboiler 104 provides the heat requirement for stripping in the second column 100. A two-column configuration may be particularly beneficial, where flexibility of an NGL plant to recover ethane or propane is especially desirable. For example, where ethane recovery is desired, the vapor portion of the stripper column overhead is fed to the bottom of the absorber section in the first column, while in cases where propane recovery is desired, the same overhead product is subcooled in the overhead subcooler and fed to the rectification section of the first column as reflux (see dashed lines in FIG. 4). With respect to the other components, the same considerations as described for FIG. 3 above apply, wherein like numerals refer to like components and streams.

With respect to the feed gas it is generally contemplated that numerous hydrocarbon containing feed gases are suitable. However, particularly preferred feed gases include natural gas, and especially natural gas with a $CO_2$ content of at least 2 mol %, more typically at least 4 mol %, and most typically at least 10 mol %. Similarly, the pressure of suitable feed gases may vary considerably, and it is generally contemplated that the feed gas pressure may be between about 300 psig to 1000-3000 psig. Consequently, and especially depending on the particular source of the feed gas, suitable feed gases may be pressurized or depressurized prior to entering the cooler or separator.

Furthermore, it should be recognized that the feed gas may be dehydrated using various methods and that the dehydration may take place at various positions within the plant. For example, the feed gas may be dehydrated prior to entry into cooler 60 or feed gas cooler 2. Consequently, the cooler 60 may be omitted, and the three-phase separator may be replaced with a two-phase separator. Alternatively, a feed gas compressor may be installed to recompress the feed stripper overhead gas 66 to the feed gas pressure before entering the main molecular sieve dryer. While the recompression process maintains a high NGL recovery, it requires additional horsepower and increases the energy consumption of the NGL recovery unit. However, it is generally preferred that the vapor portion of the feed gas is dried using molecular sieve driers as indicated in FIGS. 3 and 4. Thus, it should be recognized that the dehydration requirements in the NGL plant are significantly reduced over conventional configurations by removing water in a three-phase separator (or other configuration) before entering the feed cooler and feed stripper.

While it is generally preferred that the lean oil stream 14 is generated from the feed gas in a high-pressure separator, it should also be recognized that various alternative sources are appropriate. For example, it is contemplated that at least a portion of the lean oil may be circulated within the plant using an external supply of the lean oil, wherein at least another portion of the lean oil may leave the plant (after stripping) in the NGL product stream. The composition of contemplated lean oil will typically depend at least in part on the composition of the particular feed gas, however, it is generally preferred that the lean oil has a composition that allows for absorption of $CO_2$ and $C_2$ components in the lean oil absorption section of the demethanizer column. Consequently, the lean oil will preferably comprise a $C_4^+$ rich liquid. It should further be especially noted that the composition of the lean oil may be controlled via the feed cooler using at least one of an external refrigerant and a portion of the lean oil that is JT expanded (which may thus act as a refrigerant for the feed stream). Thus, where desirable, the composition of the lean oil may be changed to include a $C_3^+$ rich liquid, and more typically a $C_5^+$ rich liquid. Moreover, the use of JT expanded liquid from the high-pressure separator advantageously provides at least some of the feed gas cooling duty.

Subcooling of the lean oil is preferably performed using the demethanizer overhead subcooler, and it is still further preferred that the pressure and temperature of the subcooled lean oil is further reduced using a JT valve before entering the top (or position proximal to the top) of the lean oil absorption section of the column. However, in alternative aspects of the inventive subject matter, it should be recognized that subcooling of the lean oil may also be performed using a cooler or heat exchanger other than the demethanizer overhead subcooler, wherein the refrigerant for such alternative cooling may be provided by a liquid or vapor from within the NGL plant or from a source outside of the NGL plant.

In especially preferred configurations, contemplated lean oil absorption processes are integrated to the demethanizer column and located below the subcooled rectification section. Consequently, it should be recognized that such configurations will advantageously combine the efficiency of a cryogenic turboexpander process with some of the advantages of a refrigerated lean oil absorption process, thereby resulting in a highly efficient integrated process which is especially suited for processing a high $CO_2$ content feed gas for high $C_2$ recovery. Moreover, since the lean oil is produced in the course of the feed gas cooling (and particularly in the partial condensation of the vapor portion of the feed gas thereby producing a lean oil), lean oil recycling may be partially, and more typically entirely omitted and thus significantly reduce equipment and operating costs as compared to conventional refrigerated lean oil absorption processes. Thus, the lean oil absorption in the demethanizer removes a significant portion of the $CO_2$ and $C_2$ components from the gas stream, thereby preventing buildup of the $CO_2$ and $C_2$ components in the top section of the demethanizer, and consequently help reducing, if not avoiding $CO_2$ freezing problems that are encountered in heretofore known cryogenic turbo-expander processes.

In yet another aspect of the inventive subject matter, it should be appreciated that the overhead vapor from the feed stripper 65 (after drying in a molecular sieve drier) is fed back to the distillation column; where the rectifier/absorber/stripper are integrated in a single column, or to the two-column design where the rectifier/absorber and stripper are separate columns, whereas in conventional configurations the overhead gas is typically disposed of as a fuel gas, which results in a loss of the NGL recovery. Moreover, in especially preferred configurations as exemplarily depicted in FIGS. 3 and 4, the overhead vapor from the feed stripper 65 is dried and recovered to maintain a high NGL recovery without the application of vapor compression.

Contemplated configurations have generally relatively high ethane and propane recovery and that contemplated configurations exhibit an ethane recovery of at least 90% and a propane recovery of about or at least 99% while at the same time avoiding freezing of $CO_2$ in the top section of the demethanizer without an upstream $CO_2$ removal unit when the feed gas has a $CO_2$ content of at least 2 mol %. With respect to the coolers, heat exchangers, demethanizer, separators, stripper(s), and piping, it is generally contemplated that such components are readily available to a person of ordinary skill in the art, and that the particular proportions and materials may vary depending on the particular plant configuration and may be readily determined by a person of ordinary skill in the art.

Thus, contemplated plants may comprise a column comprising a rectification section and an absorption section, wherein the column is fluidly coupled to a first separator that separates a feed gas into a lean oil liquid and a vapor, wherein a first portion of the vapor is expanded in a turbo-expander and introduced into the absorption section, and wherein a second portion of the vapor is cooled and introduced into the rectification section, and wherein the lean oil liquid is cooled and introduced into the absorption section thereby reducing the carbon dioxide concentration in the rectification section of the column.

Particularly preferred plants may additionally include a second separator that receives a cooled natural gas feed and separates the cooled natural gas feed into a vapor portion of the natural gas, a liquid portion of the natural gas, and water, and wherein the feed of the first separator comprises at least some of the vapor portion of the natural gas. Where appropriate, it is preferred that the vapor portion of the natural gas is dried using molecular sieves and cooled using an overhead product of the rectification section of the column and an optional external refrigerant, while a portion of the lean oil liquid is let down in pressure and used as a refrigerant to cool the feed of the first separator.

In still further contemplated aspects, the second portion of the vapor and the lean oil liquid are cooled using an overhead product of the rectification section of the column, wherein the column may further comprise a stripping section that removes at least a portion of methane that is absorbed in the lean oil liquid and produces a bottom product comprising natural gas liquids (wherein the stripping section may further receive the portion of the lean oil liquid that is let down in pressure).

Suitable plants may include comprising a separate feed stripping column that receives the liquid portion of the natural gas, that forms a bottom product comprising natural gas liquids, and that produces a stripping column overhead product that is optionally dried, and introduced into the distillation column.

Alternatively, the distillation column of contemplated plants may be fluidly coupled to a first stripping column that receives the lean oil liquid and removes at least a portion of methane absorbed in the lean oil liquid and produces a bottom product comprising natural gas liquids (wherein the absorption section of the column may receive the portion of the lean oil liquid that is let down in pressure). A second stripping column may receive the liquid portion of the natural gas, that forms a bottom product comprising natural gas liquids, and may produce a stripping column overhead product that is optionally dried, and introduced into the column.

Consequently, a method of operating a plant may include a step in which a column having a rectification section and an absorption section is provided. In another step, a feed is separated in a first separator into a lean oil liquid and a vapor, and in yet another step, the vapor is divided in a first portion and a second portion, wherein the first vapor portion is expanded in a turbo-expander and introduced into the absorption section, and wherein the second vapor portion is cooled and introduced into the rectification section. In another step, the lean oil liquid is cooled and introduced into the absorption section, thereby reducing the carbon dioxide concentration in the rectification section of the column.

In other preferred aspects of the inventive subject matter, suitable methods may further include a step in which at least one of the second vapor portion and the lean oil liquid is cooled using an overhead product of the rectification section of the column. Additionally, or alternatively, the feed may be cooled using an overhead product of the rectification section of the column. Still further suitable methods may further include a step in which a second separator is provided in the plant inlet that receives a cooled natural gas feed and separates the cooled natural gas feed into a vapor portion of the natural gas, a liquid portion of the natural gas, and water, and wherein the feed of the first separator comprises at least some of the vapor portion of the natural gas (e.g., comprising at least 2 mol % carbon dioxide, and more typically 10 mol % carbon dioxide).

In further preferred aspects of the inventive subject, suitable methods may further include the application of a two-column configuration, wherein the first column has a rectification section and an absorption section, and wherein the second column has a stripping section. This two-column configuration can be used for either ethane or propane recovery, which provides additional benefit for ethane rejection. A two-column configuration may be particularly advantageous, where flexibility of an NGL plant to recover ethane or propane is especially desirable. Configuration for ethane recovery is accomplished by routing the second column overhead vapor to the bottom of the absorber section in the first column, while in cases where propane recovery is desired, the same overhead product is subcooled in the overhead subcooler and fed to the rectification section of the first column as reflux.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the appended contemplated claims. Moreover, in interpreting both the specification and the contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A plant comprising:

a column comprising a rectification section and an absorption section, wherein the column is fluidly coupled to a first separator that is configured to separate a feed into a lean oil liquid and a vapor;

a turbo-expander configured to expand a first portion of the vapor and fluidly coupled to the column to provide the expanded first portion to the absorption section, and an exchanger fluidly coupled to the separator and configured to cool a second portion of the vapor wherein the exchanger is fluidly coupled to the column to provide the cooled second portion as a reflux to the rectification section;

a second separator that is configured to receive a cooled natural gas feed and to separate the cooled natural gas feed into a vapor portion of the natural gas, a liquid portion of the natural gas, and water, and wherein the feed of the first separator comprises at least some of the vapor portion of the natural gas;

a feed stripping column that is configured to receive the liquid portion of the natural gas, that is configured to form a bottom product comprising natural gas liquids, and that is configured to produce a stripping column overhead product that is optionally dried, and introduced into the column; and wherein the exchanger is further configured to subcool the lean oil liquid to a temperature sufficient to condense and absorb carbon dioxide and C2 components in the column and to provide the subcooled lean oil liquid to the absorption section.

2. The plant of claim 1 further comprising a molecular sieve drier that is configured to dry the vapor portion of the natural gas.

3. The plant of claim 1 further comprising a second exchanger that is configured to cool the vapor portion of the natural gas using an overhead product of the rectification section of the column and an optional external refrigerant.

4. The plant of claim 1 further comprising an expansion device that is configured to let down in pressure a portion of the lean oil liquid to thereby provide refrigeration content to the feed of the separator.

5. The plant of claim 1 wherein the exchanger is further configured to cool the second portion of the vapor and the lean oil liquid using an overhead product of the rectification section of the column.

6. The plant of claim 1 wherein the column is configured to further comprise a stripping section that is configured to remove at least a portion of methane that is absorbed in the lean oil liquid and to produce a bottom product comprising natural gas liquids.

7. The plant of claim 4 wherein the column is configured to further comprise a stripping section that is configured to remove at least a portion of methane that is absorbed in the lean oil liquid, and to produce a bottom product comprising natural gas liquids, and wherein the stripping section is further configured to receive the portion of the lean oil liquid that is let down in pressure.

8. The plant of claim 1 wherein the column is fluidly coupled to a first stripping column that is configured to receive the lean oil liquid and to remove at least a portion of methane absorbed in the lean oil liquid and to produce a bottom product comprising natural gas liquids.

9. The plant of claim 4 wherein the column is fluidly coupled to a first stripping column that is configured to receive receives the lean oil liquid and to remove at least a portion of methane absorbed in the lean oil liquid and to produce a bottom product comprising natural gas liquids, and wherein the absorption section of the column is configured to receive the portion of the lean oil liquid that is let down in pressure.

10. The plant of claim 1 further comprising a second stripping column that is configured to receive the liquid portion of the natural gas, that is configured to form a bottom product comprising natural gas liquids, and that is configured to produce a stripping column overhead product that is optionally dried, and introduced into the column.

11. The plant of claim 1 wherein the cooled natural gas comprises at least 2 mol % carbon dioxide.

12. The plant of claim 1 wherein the cooled natural gas comprises at least 10 mol % carbon dioxide.

13. A method of operating a plant, comprising:

providing a column comprising a rectification section and an absorption section;

separating a feed in a first separator into a lean oil liquid and a vapor;

separating in a second separator a cooled natural gas feed into a vapor portion of the natural gas, a liquid portion of the natural gas, and water, and wherein the feed of the first separator comprises at least some of the vapor portion of the natural gas;

separating in a feed stripping column the liquid portion of the natural gas into a bottom product comprising natural gas liquids and a stripping column overhead product, and introducing the stripping column overhead product into the column;

dividing the vapor in a first portion and a second portion, wherein the first vapor portion is expanded in a turbo-expander and introduced into the absorption section, and wherein the second vapor portion is cooled and introduced into the rectification section as a reflux; and cooling the lean oil liquid and introducing the cooled liquid into the absorption section at a temperature sufficient to condense and absorb carbon dioxide and C2 components in the column to thereby reduce a carbon dioxide concentration in the rectification section of the column.

14. The method of claim 13 further comprising cooling at least one of the second vapor portion and the lean oil liquid using an overhead product of the rectification section of the column.

15. The method of claim 13 further comprising cooling the feed using an overhead product of the rectification section of the column.

16. The method of claim 13 further comprising providing a first and a second distillation column, wherein the first distillation column comprises a rectifier section and an absorption section, and wherein the second distillation column comprises a stripping section, thereby allowing operation in an ethane recovery mode or operation in a propane recovery mode.

17. The method of claim 13 wherein the cooled natural gas comprises at least 2 mol % carbon dioxide.

18. The method of claim 13 wherein the cooled natural gas comprises at least 10 mol % carbon dioxide.

* * * * *